United States Patent [19]

Liebermann et al.

[11] 4,343,347

[45] Aug. 10, 1982

[54] METHOD OF MAKING PATTERNED HELICAL METALLIC RIBBON FOR CONTINUOUS EDGE WINDING APPLICATIONS

[75] Inventors: Howard H. Liebermann, Schenectady; Peter G. Frischmann, Scotia, both of N.Y.; George M. Rosenberry, Jr., Hendersonville, Tenn.

[73] Assignee: General Electric Company, Schenectady, N.Y.

[21] Appl. No.: 249,033

[22] Filed: Mar. 30, 1981

Related U.S. Application Data

[62] Division of Ser. No. 972,240, Dec. 22, 1978, Pat. No. 4,281,706.

[51] Int. Cl.[3] ..... B22D 11/06; B22D 25/00

[52] U.S. Cl. ..... 164/463; 164/423; 164/429

[58] Field of Search ..... 164/463, 423, 429

[56] References Cited

U.S. PATENT DOCUMENTS

| | | | |
|---|---|---|---|
| 989,075 | 4/1911 | Staples | 164/423 |
| 2,825,108 | 3/1958 | Pond | 164/423 X |
| 2,910,744 | 11/1959 | Pond | 164/423 X |
| 3,188,505 | 6/1965 | Wiley | 310/259 |
| 3,674,084 | 7/1972 | Paliwoda | 164/271 |
| 4,155,397 | 5/1979 | Honsinger et al. | 164/423 X |
| 4,187,441 | 2/1980 | Oney | 310/112 |
| 4,211,944 | 7/1980 | Haller | 310/72 |
| 4,211,957 | 7/1980 | Alley et al. | 315/276 |

FOREIGN PATENT DOCUMENTS

| | | | |
|---|---|---|---|
| 904048 | 2/1945 | France | 164/423 |

*Primary Examiner*—R. L. Spruill
*Assistant Examiner*—J. Reed Batten, Jr.
*Attorney, Agent, or Firm*—Stephen S. Strunck; James C. Davis, Jr.; Marvin Snyder

[57] ABSTRACT

Metallic ribbon having cutout patterns therein is fabricated in continuous helical form by directing a melt stream or jet onto a rapidly moving patterned substrate surface.

13 Claims, 10 Drawing Figures

METHOD OF MAKING PATTERNED HELICAL METALLIC RIBBON FOR CONTINUOUS EDGE WINDING APPLICATIONS

The United States Government has rights in this invention pursuant to contract number DE-AC01-78ET29313 between the United States Department of Energy and the General Electric Company (41 CFR §9-9.109).

This application is a division of application Ser. No. 972,240 filed Dec. 22, 1978 and now U.S. Pat. No. 4,281,706 issued Aug. 4, 1981.

CROSS-REFERENCE TO RELATED APPLICATION

The invention herein is related to the invention disclosed and claimed in copending application Ser. No. 972,239, filed Dec. 22, 1978, in the names of the same inventive entity as the instant application, assigned to the same assignee as the instant application, and entitled "Helical Metallic Ribbon for Continuous Edge Winding Applications".

BACKGROUND OF THE INVENTION

1. Field of the Invention

This invention relates to a method for making patterned metallic ribbons in helical form for continuous edge winding applications.

2. Description of the Prior Art

The fabrication of glassy alloy magnetic ribbon for use in electric motor applications is commonly believed to involve conventional punching operations performed on sheets or strips of the ribbon. However, a low filling or packing factor will result from conventional or prior art laminations of known glassy alloys because of the greater number of punchings required when compared with the number of punchings required when using prior art materials for laminations. This is because of the inherent limit on thickness in melt-quenched glassy alloy specimens. The overall effect is to increase the size and cost of the finished electric motor, thereby negating the savings offered by use of the glassy alloy material. A prior art method of making glassy alloy ribbon is to extrude the alloy in molten form through an appropriate orifice in a crucible and to subsequently impinge the melt jet onto the circumferential surface of a rapidly rotating substrate wheel. The melt jet is typically made to lie parallel to the plane of the substrate wheel. The ribbon so formed has the shape of conventional tape or ribbon and can be wound upon a spool.

It would be desirable to manufacture a motor stator comprising two concentric pieces of material. A center piece would be prefabricated with teeth and windings. The outer piece would be prefabricated or built in situ from an edge-wound strip in the form of a large helix.

Therefore, it is an object of this invention to provide a method for making metallic ribbon in a continuous helical form.

Another object of this invention is to provide a method for making a new and improved edge-wound glassy alloy magnetic ribbon in a helical form.

A further object of this invention is to provide a method for making edge-wound metallic or glassy alloy magnetic ribbon in a nest helical form.

A still further object of this invention is to provide a method for making edge-wound metallic or glassy alloy magnetic ribbon with prefabricated cutouts therein for making, as an example, a motor stator.

Other objects of this invention will, in part be obvious and will, in part, appear hereinafter.

BRIEF DESCRIPTION OF THE INVENTION

In accordance with the teaching of this invention there is provided a method for making metallic and glassy alloy ribbons in helical form by chill block melt-spinning. The method includes the process steps of causing a substrate wheel to rotate at a predetermined speed to impart to a substrate surface thereon a predetermined velocity of from about 12 meters per second to about 50 meters per second. The substrate surface generally is oriented normal to the axis of rotation of the substrate wheel. Molten alloy is formed in a crucible and is extruded through an orifice in the crucible to form a melt stream or jet having a preferred velocity of from about 1 meter per second to about 10 meters per second.

The crucible, the orifice and the melt stream or jet have colinear axes. The crucible axis is positioned on an inverted cone in space above the moving substrate surface and intersects the apex of the cone. The position of the crucible axis on the inverted cone is defined by an inclination angle $\alpha$ and an azimuthal angle $\gamma$ having values $0 \leqq |\gamma| \leqq 180°$.

The melt stream or jet is caused to impinge onto the moving substrate surface at a predetermined angle $\alpha$ therewith. The axis of the melt stream or jet lies in a plane defined by the tangent to the rotation of the substrate wheel at the point of intersection of the crucible axis and the normal to the moving substrate surface at the same point of intersection. The angle $\alpha$ has values of $A30° \leqq \alpha \leqq 90°$ and preferably $A40° \leqq \alpha \leqq 70°$.

The molten alloy cast is rapidly quenched on the moving substrate surface to form a continuous length of an edge-wound metallic ribbon having a helical shape, a substantially uniform cross-section, a pair of opposed substantially parallel major surfaces, and inner and outer peripheral edges. The ribbon assumes an inplane curvature defined by the motion of the substrate wheel at the area of melt stream or jet impingement.

Barrier lines may be provided on the moving substrate surface in the form of a continuous geometric pattern. This geometric pattern is oriented on the moving substrate surface so as to provide a means for providing a geometrical pattern of cutouts in either or both or the inner and outer peripheral edges of the ribbon.

Other embodiments of the process include modifying at least a portion of the moving substrate surface to be inclined toward or away from the axis of rotation of the substrate wheel. Casting the molten alloy on the moving inclined substrate surface produces a continuous length of a nested helical metallic ribbon. The composition of the ribbon may be that of a glassy alloy system which may be successfully produced by rapid quenching from the melt. Typical examples of such systems are Fe-B, Fe-B-C, Fe-B-Si, Fe-Ni-B, Cu-Zr, and the like.

DESCRIPTION OF THE INVENTION

Figure 1:
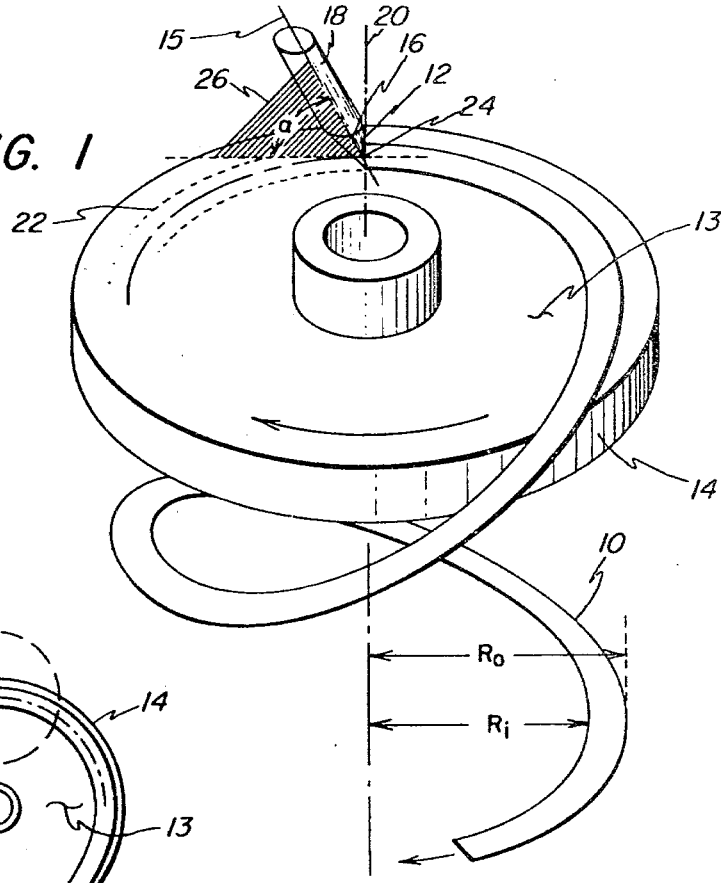
FIG. 1 is a schematic view illustrating fabrication of edge-wound metallic ribbon in a helical form.

Referring now to FIG. 1, there is shown a method of making edge-wound metallic ribbon 10. Within the limits of the present invention, a ribbon is a thin body whose transverse dimensions are very much smaller than its length.

The ribbon 10 is formed by impinging a melt stream or jet 12 onto a moving substrate surface 13 of a substrate wheel 14, rotating about axis 20, by extrusion of the molten alloy through an appropriate orifice 16 of a crucible 18. The axis 15 of the melt stream or jet 12 is made to lie in a plane 26 defined by the tangent to the rotation of the substrate wheel 14 at the point of melt stream or jet axis 15 intersection 24 and by the normal to the local substrate surface 22 at the same point 24. Upon impingement of the melt stream or jet 12 onto the portion 22 of the moving substrate surface 13 of the wheel 14, the melt is chilled into the shape of the ribbon 10 which assumes an inplane curvature defined by the motion of the wheel at the area of impingement 24. The width of the ribbon formed at the melt stream or jet impingement area 24 determines the radius of the inner and outer peripheral edge Ri and Ro, respectively, of the edge-wound helical metallic ribbon 10.

The melt stream or jet axis 15 in the plane described may intersect the portion 22 of the moving substrate surface 13 at an angle $\alpha$ typically between 30° and 90°, with the range $40° \leqq \alpha \leqq 70°$ preferred for optimized ribbon geometric uniformity. The structure of the resulting metallic ribbon may be crystalline or glassy. Glassy metallic ribbon may be made from a glassy alloy system by rapid quenching from the melt. Typical examples of glassy alloy systems are Fe-B, Fe-B-C, Fe-B-Si, Fe-Ni-B, Cu-Zr and the like.

It has been empirically found that the edge-wound ribbon most readily forms within certain limits of melt stream or jet velocity and substrate surface velocity. The preferred melt stream or jet velocity should range from about 1 m/s to about 10 m/s. The substrate surface speed preferably ranges from about 12 m/s to about 50 m/s. Precautions must be taken to assure intimate contact between the substrate surface and the cooling ribbon for a sufficient length of time in order to form a suitable helix. One particular method is to roughen the surface of the substrate wheel and thereby prolong ribbon dwell time on the surface of the wheel. Another method is to employ a gas or mechanical type of "hold-down" device which is well known to those skilled in the art.

The ribbon as formed has a substantially uniform cross-section when compared with helical products fabricated by mechanical means of deformation such, for example, as by cambered rolling. The latter products typically have a tapered cross-section wherein the thickness of the ribbon is uniformly reduced towards the outer peripheral edge across the width of the ribbon.

Figure 1A:
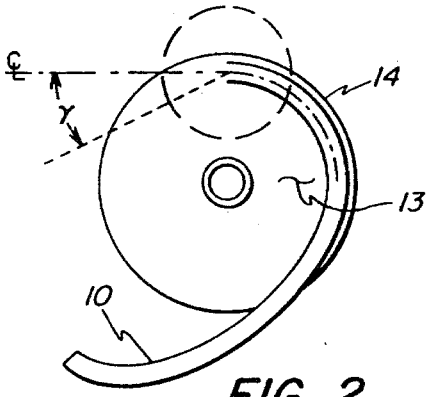
FIG. 1*a* is a top planar view of the schematic of FIG. 1 showing the azimuthal orientation of the melt flow axis in relation to the area of stream impingement on the moving substrate surface 22.

With reference to FIGS. 1 and 1*a*, the possible orientations of the crucible axis 15 with respect to the moving substrate surface may be defined by an inverted cone with apex at the point of stream axis impingement. The cone is defined by the inclination and azimuthal angles $\alpha$ and $\gamma$, respectively. Using the projection ℄ as an arbitrary reference marker, the azimuthal angle may have values of $0 \leqq |\gamma| \leqq 180°$. "Backstreaming" occurs when $|\gamma| > 90°$, thereby resulting in ribbon 10 formed in the direction of substrate motion and in droplets or a continuous stream formed against the general direction of substrate motion, sometimes resulting in a continuous fiber.

Figure 2:
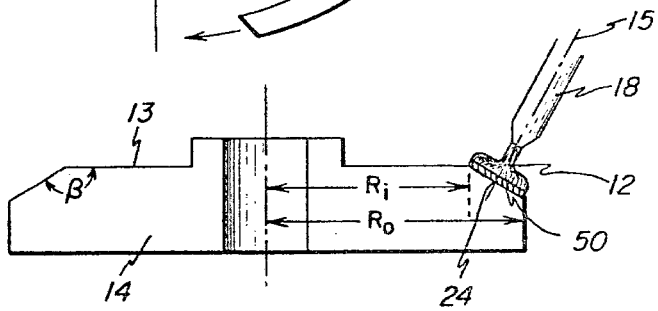
FIG. 2 is a partial cross-section schematic view of fabricating a nested edge-wound metallic ribbon in a helical form.
Figure 3:
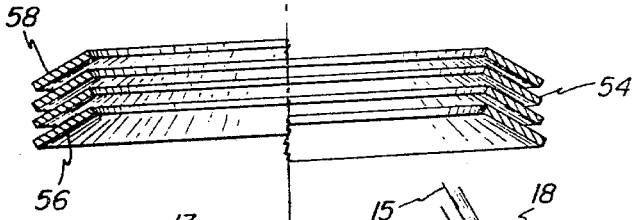
FIG. 3 is a partial cross-section side elevation view of a nested edge-wound metallic ribbon.

When the melt stream or jet 12 is made to impinge onto a beveled surface 50, that is, a portion of the substrate surface 13 which is modified by shaping it to be integral with and inclined to the remaining portion of the surface 13 of the rotating substrate wheel 14, an edge-wound helical metallic ribbon results and has a nesting angle somewhat less than that of the bevel inclination on the rotating substrate wheel 14. The surface 50 intersects the substrate surface 13 and forms the included obtuse angle $\beta$ therewith. For example, with reference to FIGS. 2 and 3, the melt jet 12 from crucible 18 is made to impinge upon the beveled surface 50 of the wheel 14 in plane 26 previously described.

The melt stream or jet 12, which is directed onto the moving substrate surface 50, has an axis 15 lying in plane 26 and inclined at $30° \leqq \alpha \leqq 90°$ with the surface 50. The plane 26 is defined by the tangent to the rotation of the substrate wheel 14 at the point of melt stream or jet axis 15 intersection 24 and by the normal to the local substrate surface 50 at the same point 24. The range $40° \leqq \alpha \leqq 90°$ is preferred for optimized ribbon geometry.

A nested glassy alloy ribbon 54 which is produced has parallel surfaces 56 and 58 inclined away from the central axis 20 of the helical coil.

Figure 4:
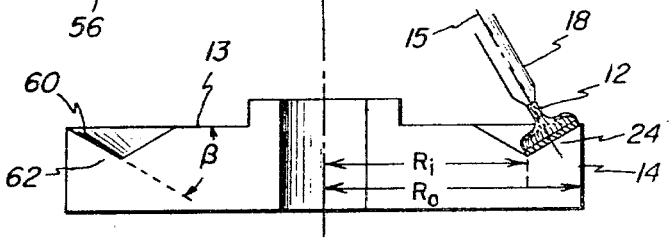
FIG. 4 is a partial cross-section schematic view of fabricating nested edge-wound metallic ribbon in a helical form.
Figure 5:
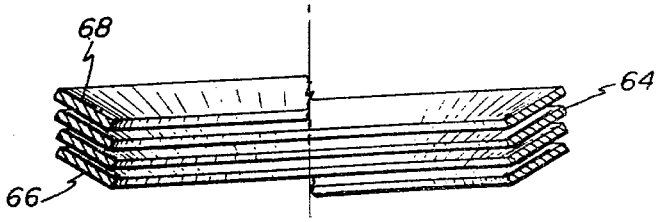
FIG. 5 is a partial cross-section side elevation view of a nested edge-wound metallic ribbon.

Alternately, as shown in FIGS. 4 and 5, the melt stream or jet 12 from crucible 18 is made to impinge on a beveled surface 60 formed in the outer portion 62 of the substrate surface 13 of the wheel 14. The surface 60 intersects an extension of the surface 13 of the wheel 14 and forms an included acute angle $\beta$ therewith. The melt stream or jet 12, which is directed onto the moving substrate surface 60, has an axis 15 lying in plane 26 and inclined at $30° \leqq \alpha \leqq 90°$ with the surface 60. The plane 26 is defined by the tangent to the rotation of the substrate wheel 14 at the point of melt stream or jet axis 15 intersection 24 and by the normal to the local substrate surface 60 at the same point 24. The range $40° \leqq \alpha \leqq 70°$ is preferred for optimized ribbon geometry. The nested metallic ribbon 64 which is produced has substantially parallel surfaces 66 and 68 which are inclined toward the central axis 20 of the helical coil.

Figure 6:
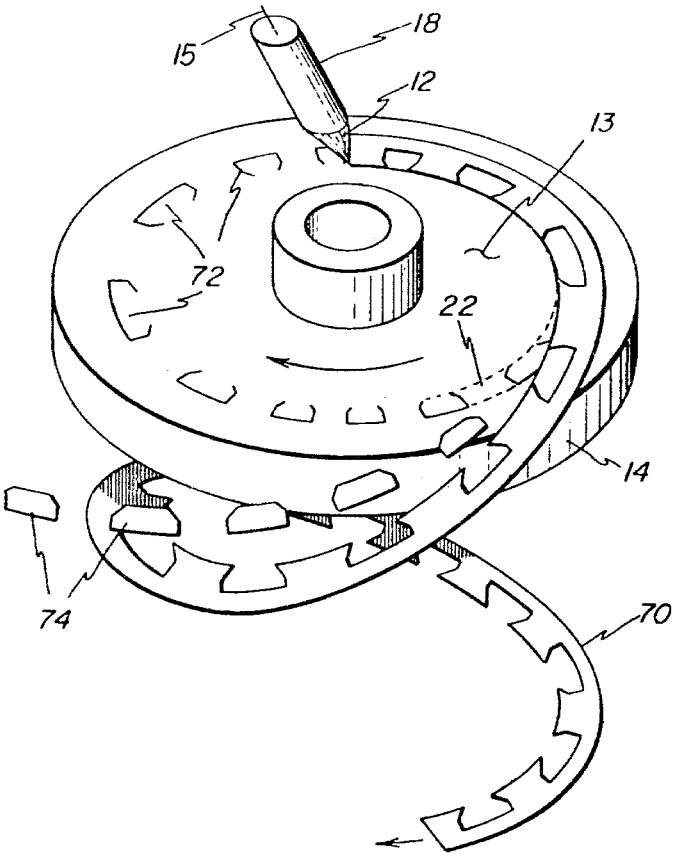
FIGS. 6, 7 and 8 are schematic views of fabricating an edge-wound metallic ribbon with a continuous pattern of predetermined periodic geometry in either one or both of the inner or the outer peripheral edges of the ribbon.

Referring to FIG. 6, the portion 22 of the moving substrate surface 13 on the rotating substrate wheel 14 may be modified in order to form a metallic ribbon 70 with predetermined cutout regions therein. The substrate surface portion 22 is modified by suitable means to contain barrier lines. For example, such lines may be introduced by scribing with a sharp-edged tool or by a silk screening ink application to produce a plurality of lines 72 which define the geometric configuration of the cutout to be made in the inner peripheral portion of the ribbon 70. The lines 72 provide a differential cooling rate between the molten metal cast on the lines 72 and the metal cast on the substrate surface portion 22. The lines 72 made either by the removal of the material from the substrate surface portion 22 or by the application of ink provide a barrier which prevents the cast metal from cooling rapidly in the vicinity thereof. Therefore, the alloy cast as the result of the contact of the melt and the moving substrate surface portion 22 produces the metallic ribbon. Centrifugal force causes the ribbon 70 to be cast from the wheel after an adequate dwell time required to define the helical shape and causes the portion of the ribbon 70 enclosed by scribe marks to break or flake away and produce individual amorphous flakes or platelets 74. The ribbon 70 is suitable for many types of electromagnetic devices such as, for example, the rotor and stator portions of an electric motor, and applications requiring a pre-defined air gap such as in a ballast or in a linear reactor.

Figure 7:
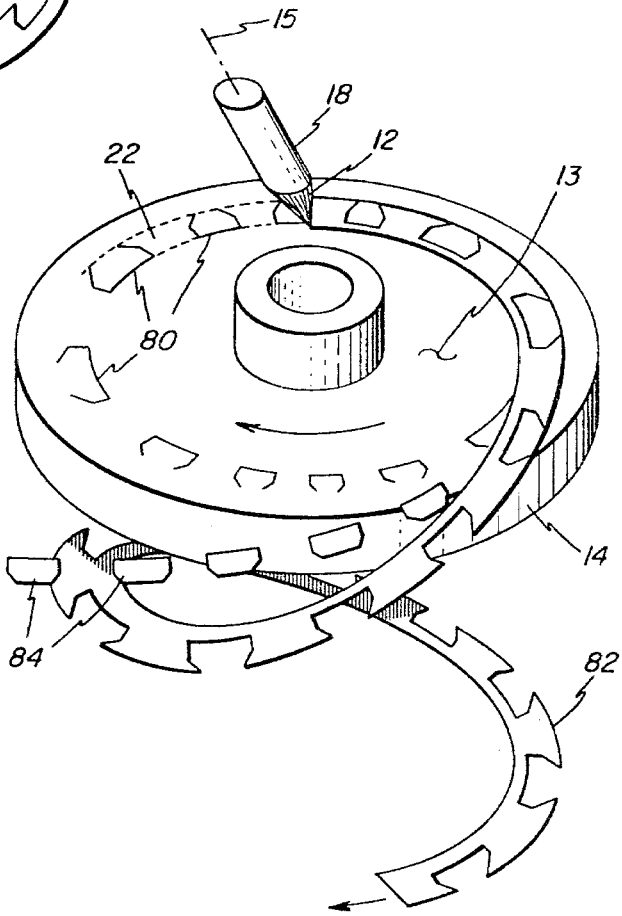

With reference to FIG. 7, there is shown another alternate embodiment of the ribbon 10. In this instance, lines 80 are made on the substrate surface portion 22 of the wheel 14 to form metallic ribbon 82 suitable for use in making the rotor portion of an electric motor. Again, metallic flakes 84 are a by-product. The cutouts are made in the outer peripheral portion of the ribbon 82.

The glassy alloy ribbons 70 and 82 may be employed in AC motor stator for a squirrel cage induction or synchronous motor. The ribbon 82 is suitable for the direct casting of one or more components of an AC motor for squirrel cage induction, synchronous with or without amortisseur windings, or hysteresis motors as well as DC or universal motor parts.

Alternately, the barrier imposed by the scribe lines 72 and 80 may be obtained by employing a low thermal conducting, a non-thermal conducting, or a non-wetting medium to delineate the pattern of the flakes 74 and 84.

The flakes or platelets 74 and 84 may be employed in making composites or encapsulated shaped articles made from the flakes.

Figure 8:
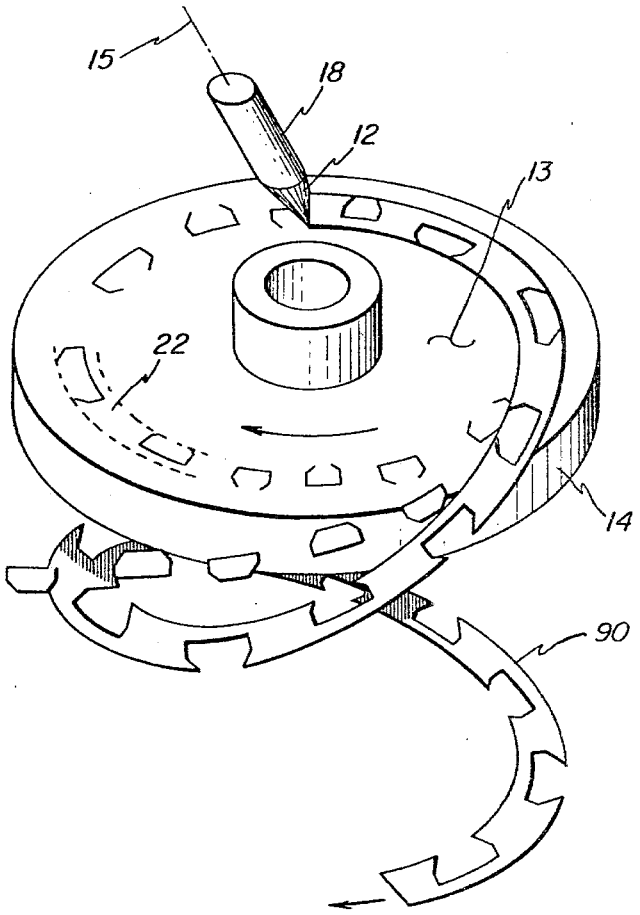

Referring now to FIG. 8, there is shown a ribbon 90 which embodies cutouts in both the inner and outer peripheral edges of ribbon 90. The ribbon 90 is manufactured in a process which embodies a process very similar to that required for producing ribbons 70 and 82. Metallic flakes are a by-product of the process.

The following examples are illustrative of the teachings of this invention:

EXAMPLE I

The substrate was provided by the face of a 7.5 cm diameter OFHC copper wheel as shown in FIG. 1 finished with 400 grit emery paper and rotating at 8500 rpm. Angles $\alpha$ and $\gamma$ were set at 50° and 0°, respectively. The angle $\beta$ was 180°. The $Fe_{40}Ni_{40}B_{20}$ molten alloy jet was at 1200° C. and was formed by extrusion under 60 kPa Ar driving pressure through a 500 μm hole in a clear fused quartz crucible. The point of melt jet impingement was at a radius of 3 cm from the axis of the rotating wheel. The resultant product was a glassy alloy helix with average diameter 6 cm, ribbon width 0.9 mm, and ribbon thickness 38 μm, as measured by a micrometer.

EXAMPLE II

The substrate was provided by the face of a 7.5 cm diameter OFHC copper wheel as shown in FIG. 1 finished with 400 grit emery paper and rotating at a speed resulting in 35 m/s substrate surface speed at point of impingement. Angles $\alpha$ and $\gamma$ were set at 70° and 0°, respectively. The angle $\beta$ was 150°. The $Fe_{40}Ni_{40}B_{20}$ jet was formed by pressurization with 60 kPa Ar and extrusion of the melt through a 500 μm round orifice at 1200° C. The resulting helical glassy alloy ribbon sample had an average diameter equal to that of the wheel at the point of melt jet impingement. The nesting angle of the helix was some 10°–15° less than $\beta$.

Although the invention has been described relative to the employment of a free jet stream impinging upon the moving substrate surface to form a dynamic melt puddle from which ribbon is drawn, the apparatus of M. C. Narasimhan, appropriately modified, may be employed as well. The apparatus and process of using it is taught in Belgian Pat. No. 859,694 issued Jan. 2, 1978. In the apparatus of M. C. Narasimhan, the molten alloy jet stream is kept confined to within a full breadth of the slit used in casting.

Figure 9:
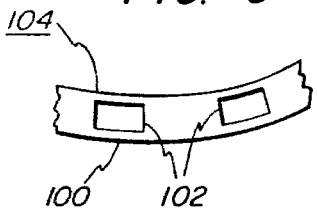
FIG. 9 is a schematic view of a portion of ribbon illustrating a continuous geometric pattern within the ribbon.

The invention has been described with the possible embodiment of a continuous pattern of geometric cutouts in either or both of the peripheral portions of the ribbon. However, a continuous pattern of a specific geometry may also be provided within the ribbon itself in order to meet motor performance standards. With reference to FIG. 9, there is shown a portion 100 of a ribbon 104 having walls 102 defining a cut-out in the ribbon which is part of a continuous pattern. The ribbon 104 is manufactured in the same manner as the previous ribbons and employing the same barrier line technique to obtain the continuous pattern. The cut-outs may be of any planar geometrical configuration and are determined by the required motor performance for which the ribbon is employed.

We claim as our invention:

1. A method of casting patterned metallic ribbons in helical form by chill block melt-spinning including the process steps of:

a. providing a substrate wheel, said wheel having major opposed top and bottom surfaces and a peripheral edge surface area interconnecting said major surfaces, said top surface lying normal to the axis of rotation of said wheel and being a casting surface;

b. providing a predetermined pattern on said casting surface forming thereby a patterned casting region, said pattern being delineated by means of barrier lines;

c. rotating said substrate wheel at a predetermined speed to impart to said patterned casting region a predetermined surface velocity;

d. positioning a crucible with respect to the moving patterned casting region with the orientation of the longitudinal axis of said crucible with respect to said patterned casting region being defined by the inclination angle $\alpha$ and azimuthal angle $\gamma$;

e. forming molten alloy of a predetermined composition in said crucible;

f. ejecting said molten alloy through an orifice in said crucible to form a melt stream having a preferred velocity, said orifice and said melt stream having axes substantially colinear with the axis of said crucible;

g. impinging said melt stream onto said moving patterned casting region; and h. rapidly chilling said molten alloy impinging on said moving patterned casting region to form a continuous length of metallic ribbon edge-wound in a helical shape, said ribbon having a substantially uniform cross section, a pair of substantially parallel major surfaces, a pattern of cutouts therein corresponding to said predetermined pattern on said casting surface, and inner and outer peripheral edges of constant radii defined by the motion of said patterned casting region at the locus of impingement of said melt stream thereon.

2. A method of casting nested patterned metallic ribbons in helical form by chill block melt-spinning including the process steps of:

a. providing a substrate wheel, said wheel having major opposed top and bottom surfaces and a peripheral edge surface area interconnecting said major surfaces, said top surface lying normal to the axis of rotation of said wheel, said wheel having a casting surface thereon, said casting surface being contiguous with at least said top surface and being the lateral area of the frustrum of a right circular cone, the axis of said right circular cone being substantially coincident with said axis of rotation with the apex of said right circular cone being above said top surface;

b. providing a predetermined pattern on said casting surface forming thereby a patterned casting region, said pattern being delineated by means of barrier lines;

c. rotating said substrate wheel at a predetermined speed to impart to said patterned casting region a predetermined surface velocity;

d. positioning a crucible with respect to the moving patterned casting region with the orientation of the longitudinal axis of said crucible with respect to said patterned casting region being defined by the inclination angle $\alpha$ and the azimuthal angle $\gamma$;

e. forming molten alloy of a predetermined composition in said crucible;

f. ejecting said molten alloy through an orifice in said crucible to form a melt stream having a preferred velocity, said orifice and said melt stream having axes substantially colinear with the axis of said crucible;

g. impinging said melt jet stream onto said moving patterned casting region; and h. rapidly chilling said molten alloy impinging on said moving patterned casting region to form a continuous length of nested patterned metallic ribbon edge-wound in a helical shape, said ribbon having a substantially uniform cross section, a pair of substantially parallel major surfaces, a pattern of cutouts therein corresponding to said predetermined pattern on said casting surface, and inner and outer peripheral edges of constant radii defined by the motion of said patterned casting region at the locus of impingement of said melt stream thereon, said ribbon leaving said moving patterned casting region with said substantially parallel major surfaces inclined away from the central axis of the helical coil.

3. A method of casting nested patterned metallic ribbons in helical form by chill block melt-spinning including the process steps of:

a. providing a substrate wheel, said wheel having major opposed top and bottom surfaces and a peripheral edge surface interconnecting said major surfaces, said top surface lying normal to the axis of rotation of said wheel, said wheel having a casting surface thereon, said casting surface being contiguous with at least said top surface and being the lateral area of the frustrum of a right circular cone, the axis of said right circular cone being substantially coincident with said axis of rotation with the apex of said right circular cone being below said top surface;

b. providing a predetermined pattern on said casting surface forming thereby a patterned casting region, said pattern being delineated by means of barrier lines;

c. rotating said substrate wheel at a predetermined speed to impart to said patterned casting region a predetermined surface velocity;

d. positioning a crucible with respect to the moving patterned casting region with the orientation of the longitudinal axis of said crucible with respect to said patterned casting region being defined by the inclination angle $\alpha$ and the azimuthal angle $\gamma$;

e. forming molten alloy of a predetermined composition in said crucible;

f. ejecting said molten alloy through an orifice in said crucible to form a melt stream having a preferred velocity, said orifice and said melt stream having axes substantially colinear with the axis of said crucible;

g. impinging said melt jet stream onto said moving patterned casting region; and h. rapidly chilling said molten alloy impinging on said moving patterned casting region to form a continuous length of nested patterned metallic ribbon edge-wound in a helical shape, said ribbon having a substantially uniform cross section, a pair of substantially parallel major surfaces, a pattern of cutouts therein corresponding to said predetermined pattern on said casting surface, and inner and outer peripheral edges of constant radii defined by the motion of said patterned casting region at the locus of impingement of said melt stream thereon, said ribbon leaving said moving patterned casting region with said substantially parallel major surfaces inclined toward the central axis of the helical coil.

4. The method of claim 1, 2 or 3 wherein the angle $\alpha$ is from 10° to 90°, the melt stream velocity is from about 1 meter per second to about 10 meters per second, and the surface velocity of said moving patterned casting region is from about 12 meters per second to about 50 meters per second.

5. The method of claim 4 wherein the angle $\alpha$ is from 40° to 70°.

6. The method of claim 1, 2 or 3 wherein the molten alloy is a glassy alloy selected from the group consisting of Fe-B, Fe-B-C, Fe-B-Si, Fe-Ni-B, and Cu-Zr.

7. The method of claim 1, 2 or 3 wherein said azimuthal angle has values of $0 \leqq |\gamma| \leqq 180°$.

8. The method of claim 1, 2 or 3 wherein said barrier lines are provided by scribing lines into said casting surface.

9. The method of claim 1, 2 or 3 wherein said barrier lines are of a lower thermal conductivity material than the material of said casting surface.

10. The method of claim 1, 2 or 3 wherein said barrier lines are non-wetting with respect to said molten alloy.

11. The method of claim 1, 2 or 3 wherein said predetermined pattern intersects said inner and outer peripheral edges of the patterned ribbon to be cast.

12. The method of claim 1, 2 or 3 wherein said predetermined pattern intersects at least one of said inner and outer peripheral edges of the patterned ribbon to be cast.

13. The method of claim 1, 2 or 3 wherein said predetermined pattern is located interior to said inner and outer peripheral edges of the patterned ribbon to be cast.

* * * * *